US007922001B2

(12) United States Patent
Meers

(10) Patent No.: US 7,922,001 B2
(45) Date of Patent: Apr. 12, 2011

(54) STACKABLE AND NESTABLE TRAY

(75) Inventor: Ryan C. Meers, Los Angeles, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 834 days.

(21) Appl. No.: 11/548,236

(22) Filed: Oct. 10, 2006

(65) Prior Publication Data

US 2008/0083638 A1 Apr. 10, 2008

(51) Int. Cl.
*B65D 21/00* (2006.01)
*B65D 85/62* (2006.01)

(52) U.S. Cl. ..... 206/505; 206/507; 206/515; 206/518; 206/519

(58) Field of Classification Search ..... 206/505, 206/507, 515, 518, 519
See application file for complete search history.

(56) References Cited

U.S. PATENT DOCUMENTS

| | | | | | |
|---|---|---|---|---|---|
| 3,405,810 | A | * | 10/1968 | Rogus | 211/126.2 |
| 3,498,494 | A | * | 3/1970 | Voorhees, Jr. | 206/501 |
| 3,734,341 | A | * | 5/1973 | Levenhagen | 206/507 |
| 3,934,724 | A | * | 1/1976 | Johnson | 206/507 |
| 4,027,796 | A | * | 6/1977 | Martin | 206/507 |
| 4,106,623 | A | * | 8/1978 | Carroll et al. | 206/506 |
| 4,139,098 | A | * | 2/1979 | Mollon | 206/507 |
| 5,042,674 | A | * | 8/1991 | Ramsay et al. | 220/4.24 |
| 5,344,022 | A | * | 9/1994 | Stahl | 206/507 |
| D354,167 | S | * | 1/1995 | Stahl | D3/304 |
| 5,752,602 | A | * | 5/1998 | Ackermann et al. | 206/507 |
| 6,394,274 | B1 | * | 5/2002 | Cheeseman | 206/511 |

FOREIGN PATENT DOCUMENTS

| | | |
|---|---|---|
| DE | 200 20 879 | 5/2001 |
| EP | 1 634 815 | 3/2006 |
| FR | 2 621 297 | 4/1989 |
| JP | 2006 001563 | 1/2006 |
| WO | 2005/095217 | 10/2005 |

OTHER PUBLICATIONS

European Search Report for EP Application No. 07019749.6, Feb. 18, 2008.

* cited by examiner

*Primary Examiner* — Anthony Stashick
*Assistant Examiner* — Madison L Wright
(74) *Attorney, Agent, or Firm* — Carlson,Gaskey & Olds

(57) ABSTRACT

A container having complementary walls that provide 180 nest/stack functionality. Opposing walls, despite being dissimilar, include outer contact surfaces that provide consistent, rigid contact with arms of a storage and retrieval system. One end wall of the container includes alternating inner and outer portions. The other end wall of the container includes complementary alternating inner and outer portions. The outer surface of at least one of the inner portions of one end wall includes a plurality of ribs providing a contact surface. The outer surface of at least one of the outer portions of the opposite end wall has a plurality of ribs extending outwardly to an end wall face. The ribs of the one wall and the end wall face of the opposite wall provide similar contact surfaces for arms of an automated storage and retrieval system.

30 Claims, 14 Drawing Sheets

STACKABLE AND NESTABLE TRAY

BACKGROUND OF THE INVENTION

The present invention relates generally to a stackable and nestable tray.

There are known containers that are nestable when oriented alike and stackable when oriented 180 degrees relative to one another. Opposing walls of the containers are complementary, such that walls of a lower container will support a similar container stacked thereon in the 180 degree orientation.

The asymmetric walls may be difficult to handle in an automated storage and retrieval system. The walls may have different shapes and areas of strength, but the storage and retrieval system needs to contact the walls in the same location to push it along a conveyor or path, for example, without regard for the orientation of the container or which of the walls it is contacting.

SUMMARY OF THE INVENTION

The present invention provides a container having complementary walls that provide 180 nest/stack functionality. Opposing walls, despite being dissimilar, include outer contact surfaces that provide consistent, rigid contact with arms of a storage and retrieval system.

One end wall of the container includes alternating inner and outer portions. The other end wall of the container includes complementary alternating inner and outer portions. The outer surface of at least one of the inner portions of one end wall includes a plurality of ribs providing a contact surface. The outer surface of at least one of the outer portions of the opposite end wall has a plurality of ribs extending outwardly to an end wall face. The ribs of the one wall and the end wall face of the opposite wall provide similar contact surfaces for arms of an automated storage and retrieval system.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
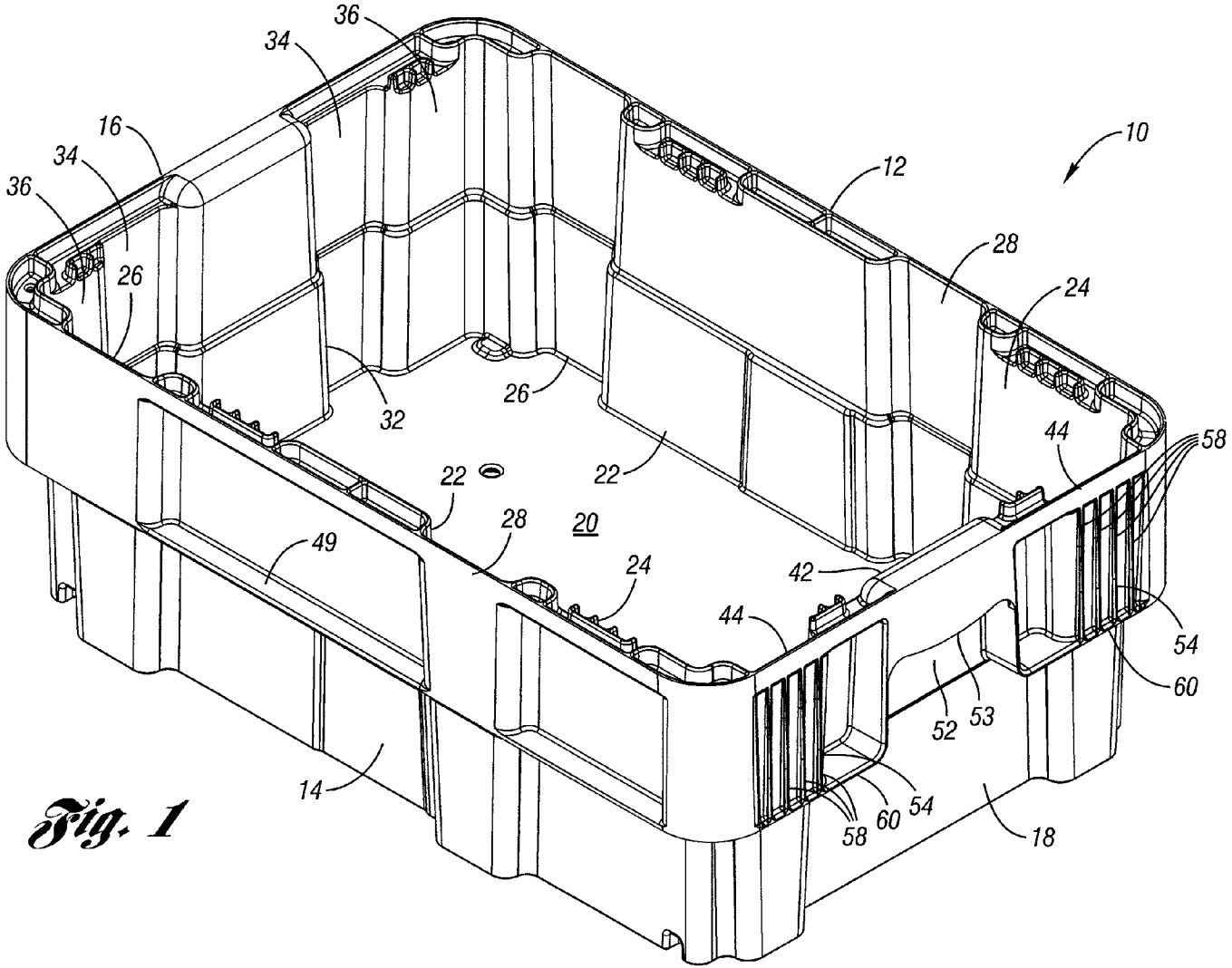
FIG. 1 is a perspective view of a container according to a first embodiment of the present invention.
Figure 2:
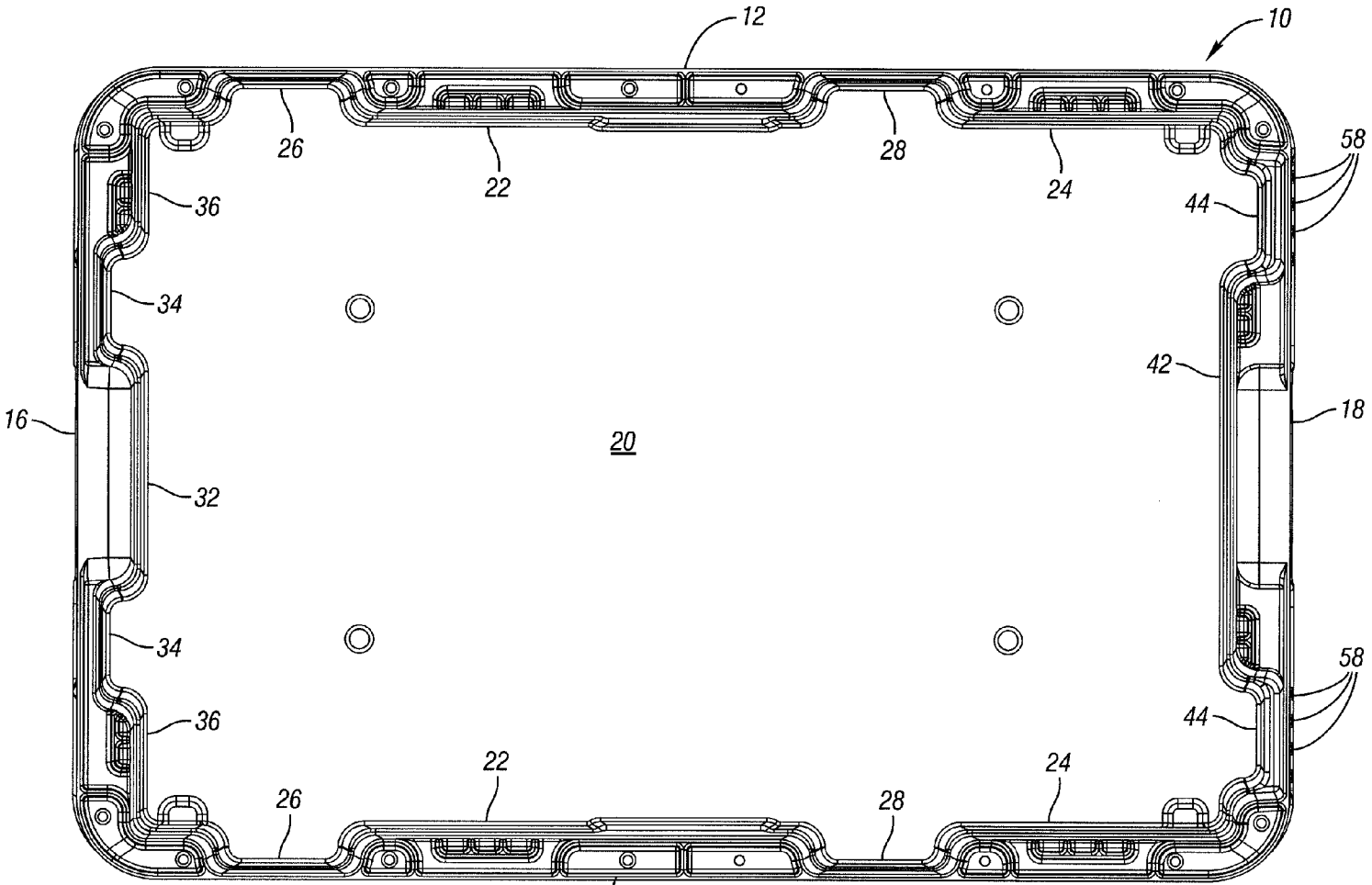
FIG. 2 is a top view of the container of FIG. 1.

Referring to FIGS. 1 and 2, a container 10 includes a pair of opposed side walls 12, 14, a pair of opposed end walls 16, 18 and a floor 20. In order to provide the 180 degree stacking and nesting functionality, the side walls 12, 14 and end walls 16, 18 include alternating inward and outward offset portions. Although one arrangement of the alternating portions is described with respect to the first embodiment, other arrangements could be used.

In example shown, the side wall 12 is a mirror image of the side wall 14. Each of the side walls 12, 14 includes a first inner portion 22 and a second inner portion 24. Each of the side walls 12, 14 further includes a first outer portion 26 and a second outer portion 28. A horizontal rib 49 divides an upper wall portion from a slightly tapered lower wall portion.

The end walls 16, 18 in the example shown are complementary. The end wall 16 includes a center inner portion 32 with adjacent outer portions 34 on either side, and second inner portions 36 adjacent the outer portions 34. The end wall 18 includes a center inner portion 42 that is larger than the center inner portion 32 of the end wall 16. The end wall 18 further includes adjacent outer portions 44. The center inner portion 42 includes a single wall 52 and a handle 53 spaced outwardly from the center inner portion 42. The outer portions 44 include a wall 54 and a plurality of ribs 58 extending vertically and perpendicularly from the wall 54 and terminating at a horizontal rib 60.

Figure 3:
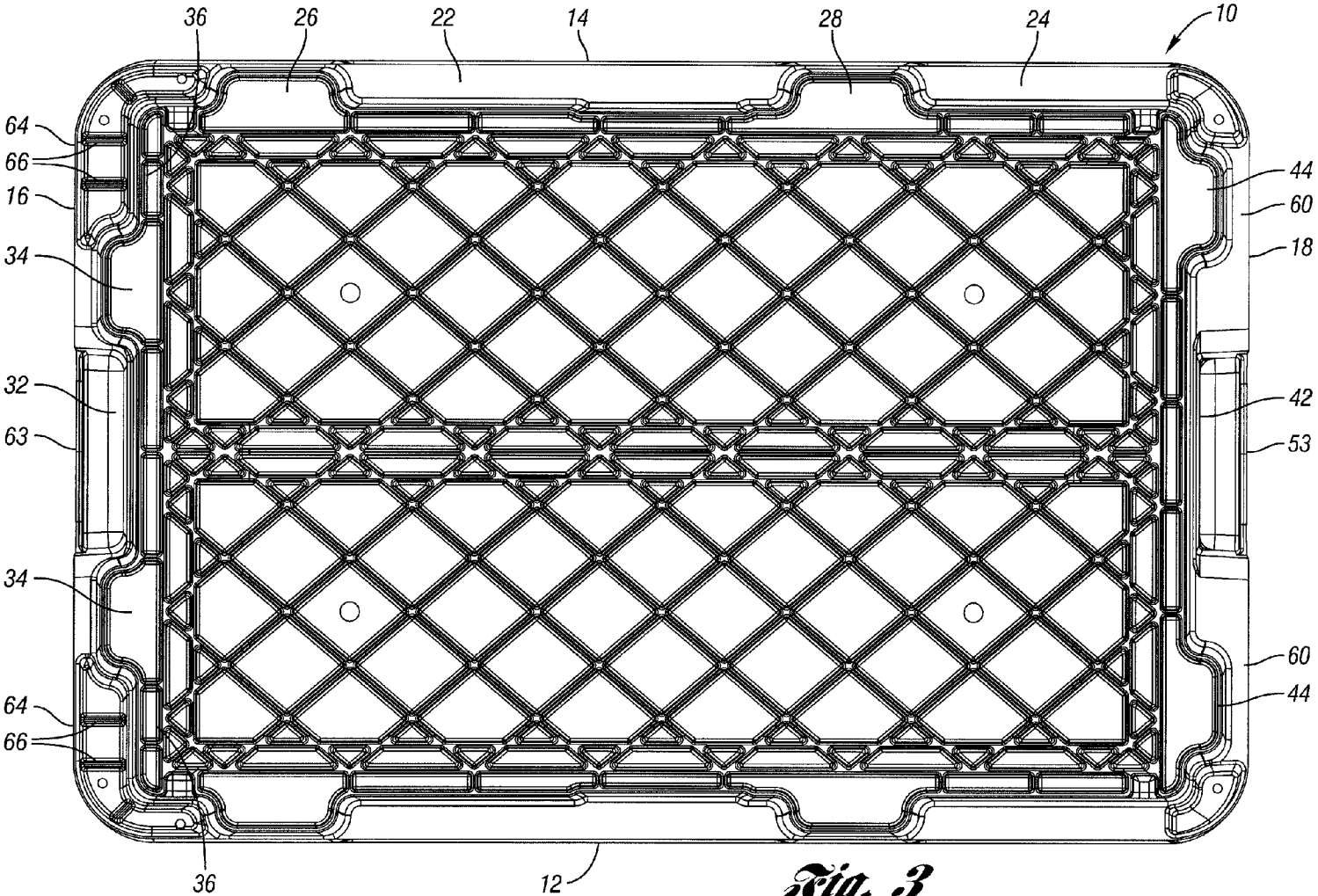
FIG. 3 is a bottom view of the container of FIG. 1.

FIG. 3 is a bottom view of the container 10. A handle 63 is spaced outwardly of the center inner portion 32 of the end wall 16. The second inner portions 36 of the end wall 16 have reinforcing ribs 66 extending perpendicularly outward therefrom and an end face wall 64 over the outer ends of the reinforcing ribs 66. At the corresponding location on the opposite wall 18, the outer potions 44 would provide only a single wall for contact with automated handling equipment, as will be explained later below. For this reason, the ribs 58 and rib 60 reinforce the outer portions 44.

Figure 4:
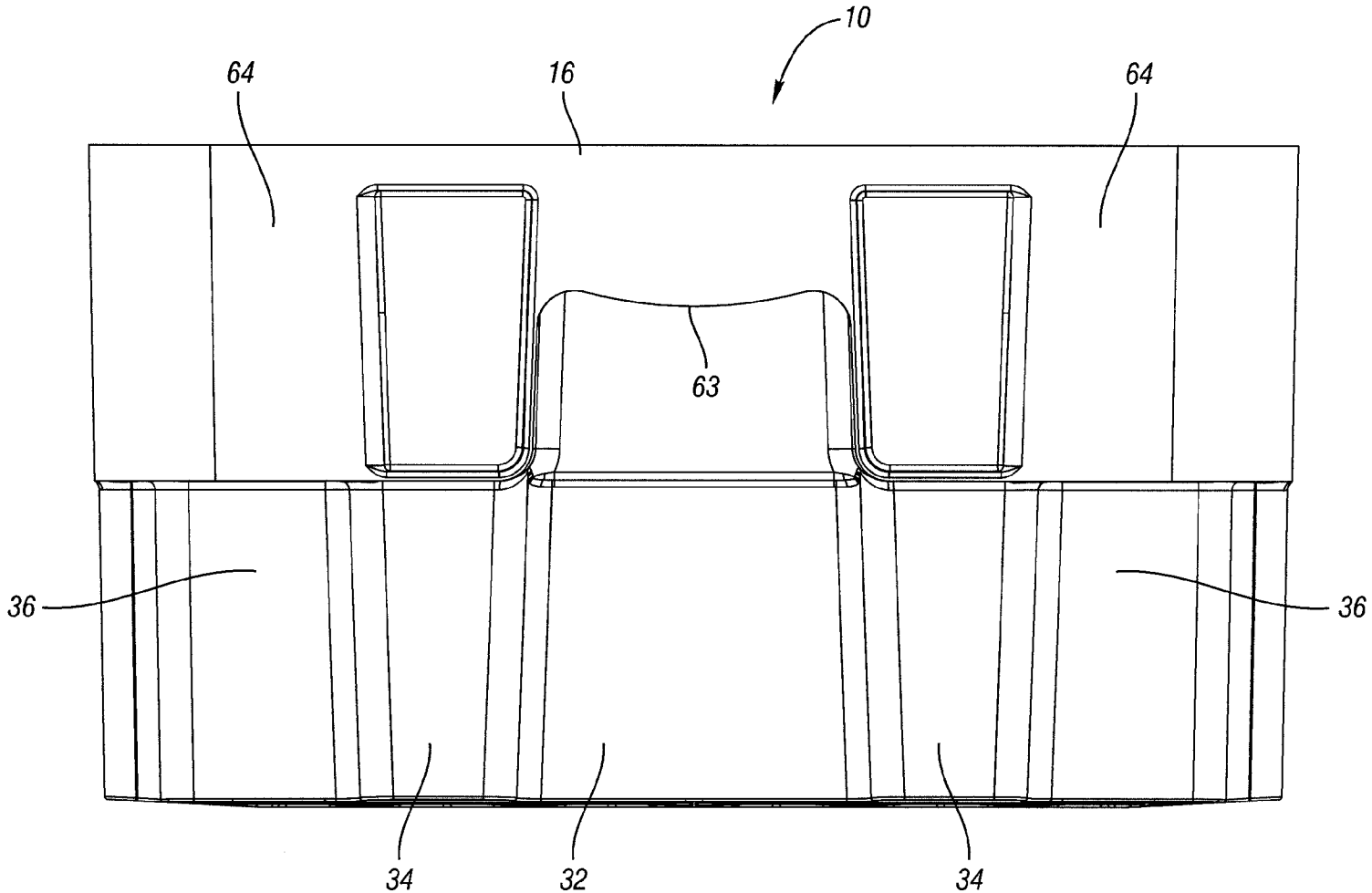
FIG. 4 is a view of one end of the container of FIG. 1.

FIG. 4 is an end view of end wall 16 of the container 10. As shown, the walls 64 provide an end face wall 64 that is flush with the handle 63.

Figure 5:
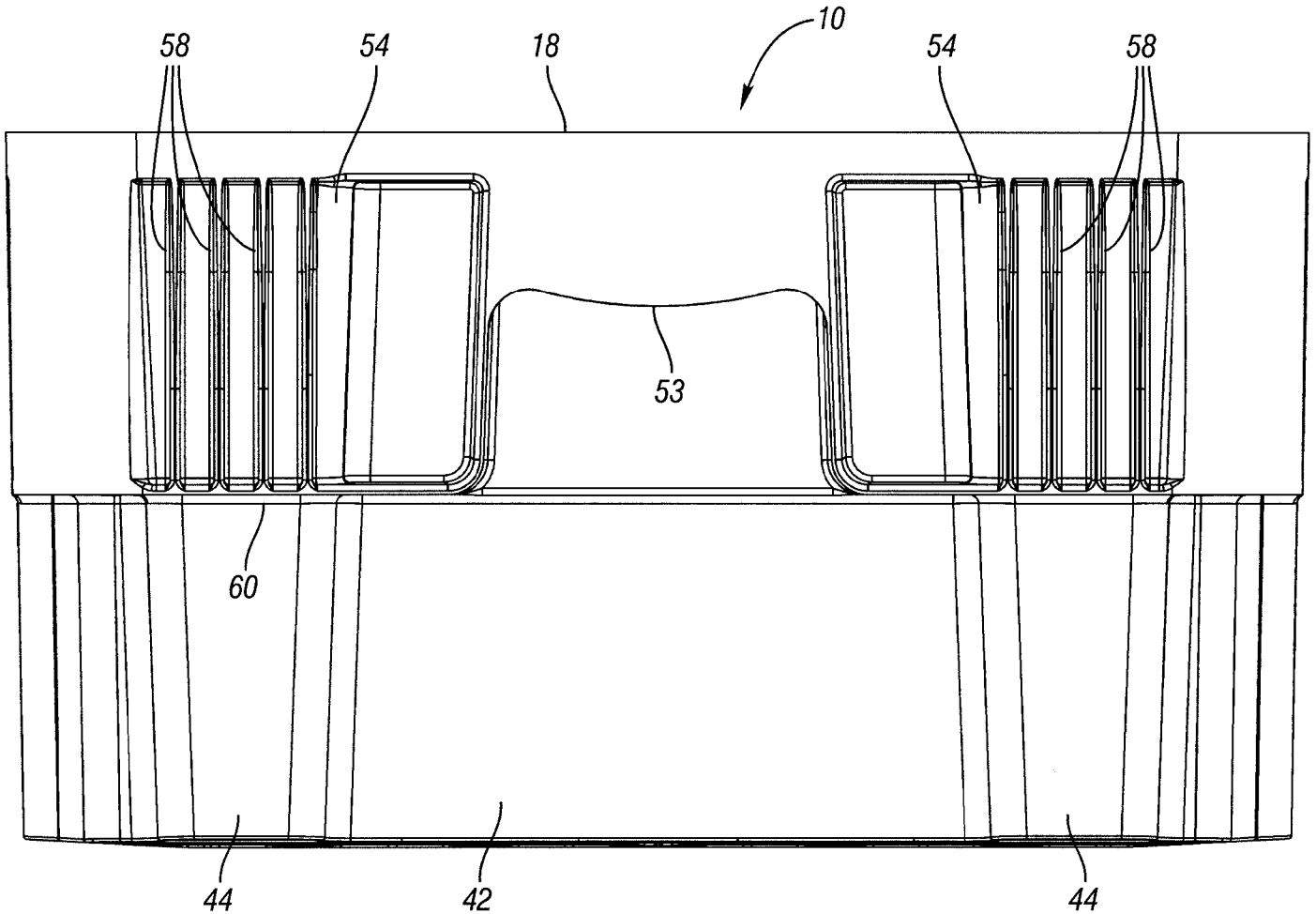
FIG. 5 is a view of the other end of the container of FIG. 1.
Figure 6:
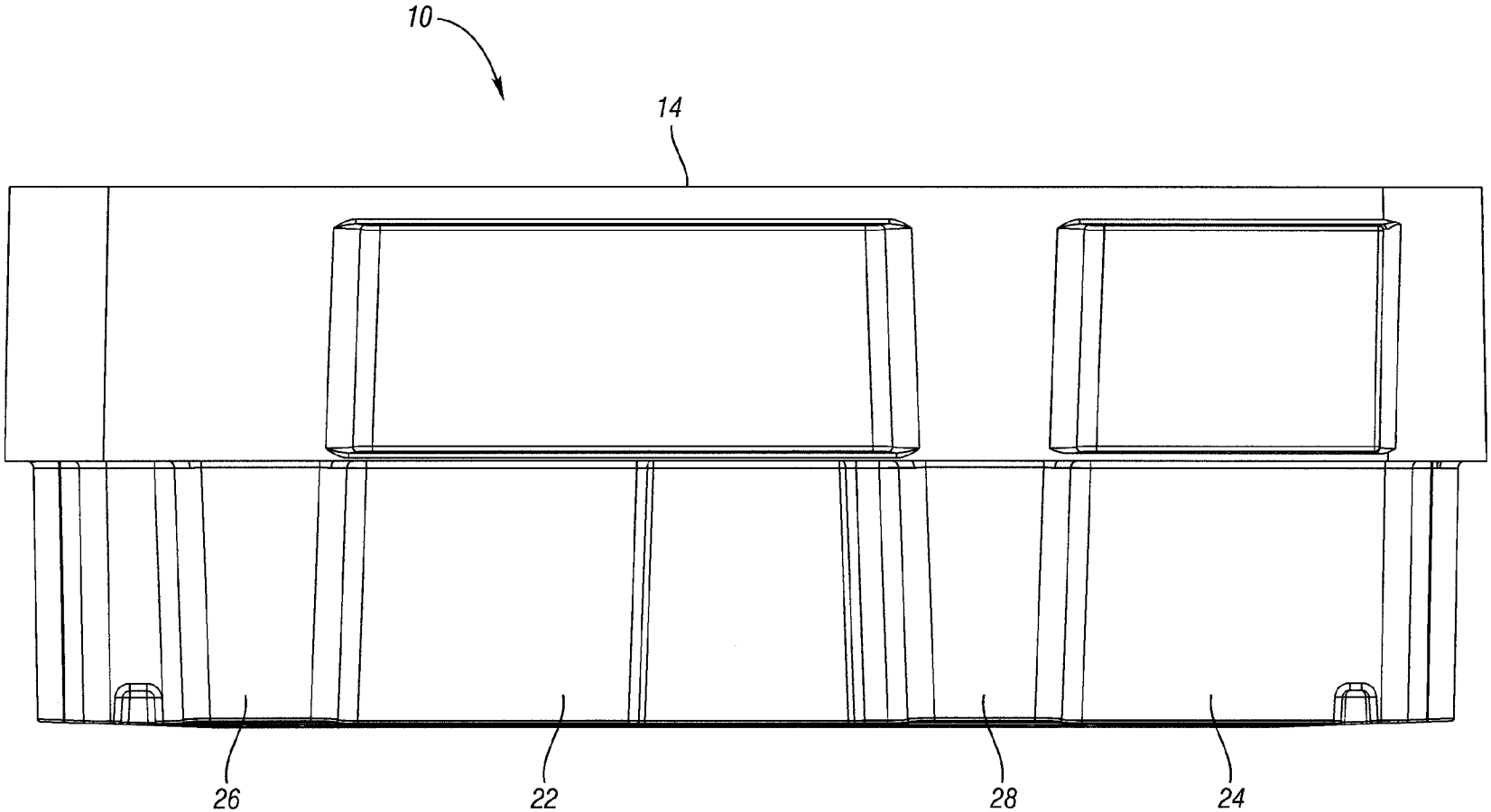
FIG. 6 is a front view of the container of FIG. 1.

Referring to FIG. 5, the outer ends of the ribs 58 are flush with the handle 53. The rib 60 divides an upper end wall portion from a slightly tapered lower end wall portion. FIG. 6 is a side view of side wall 14.

Figure 7:
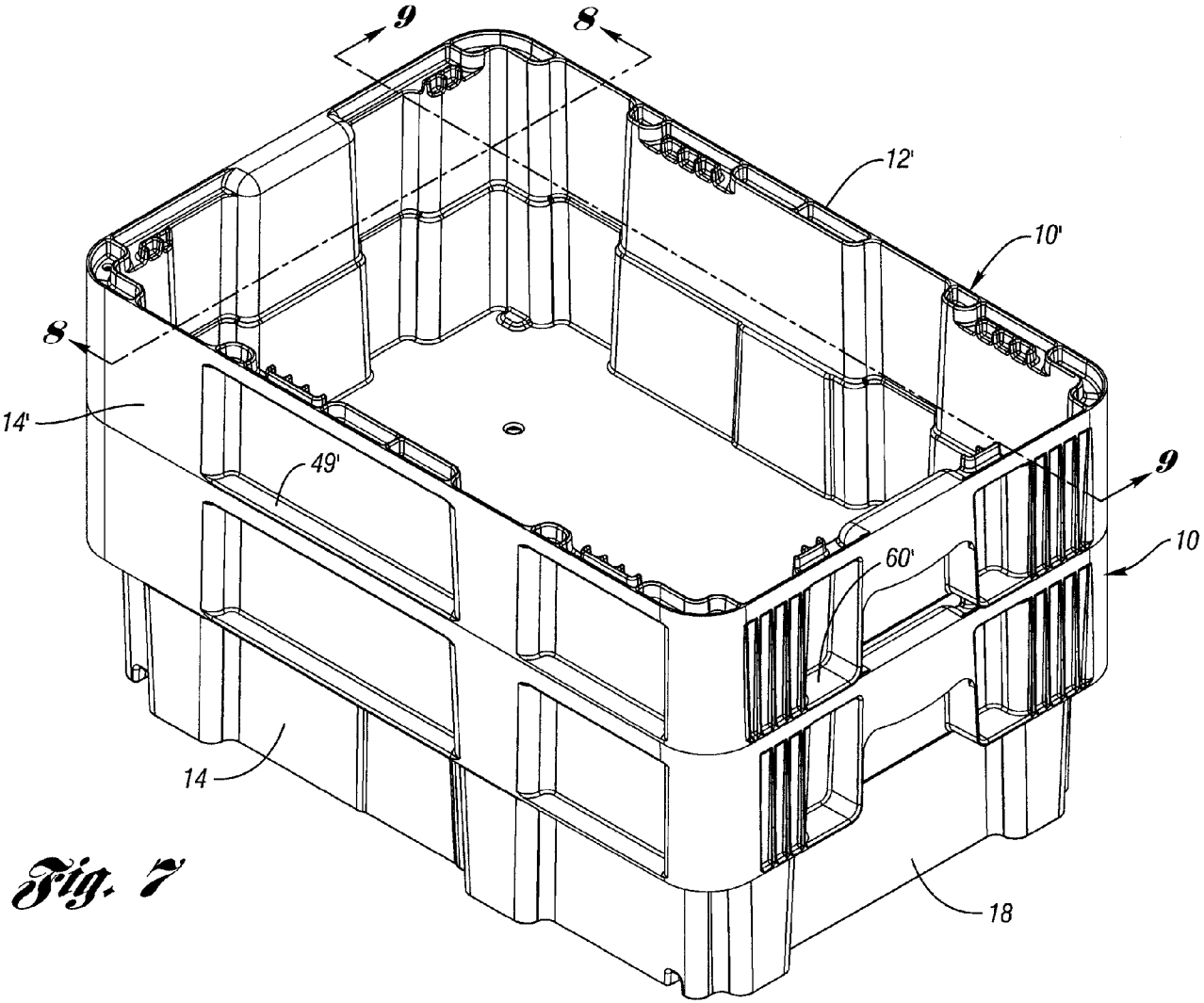
FIG. 7 is a perspective view of the container of FIG. 1 with a similar container nested therein.
Figure 8:
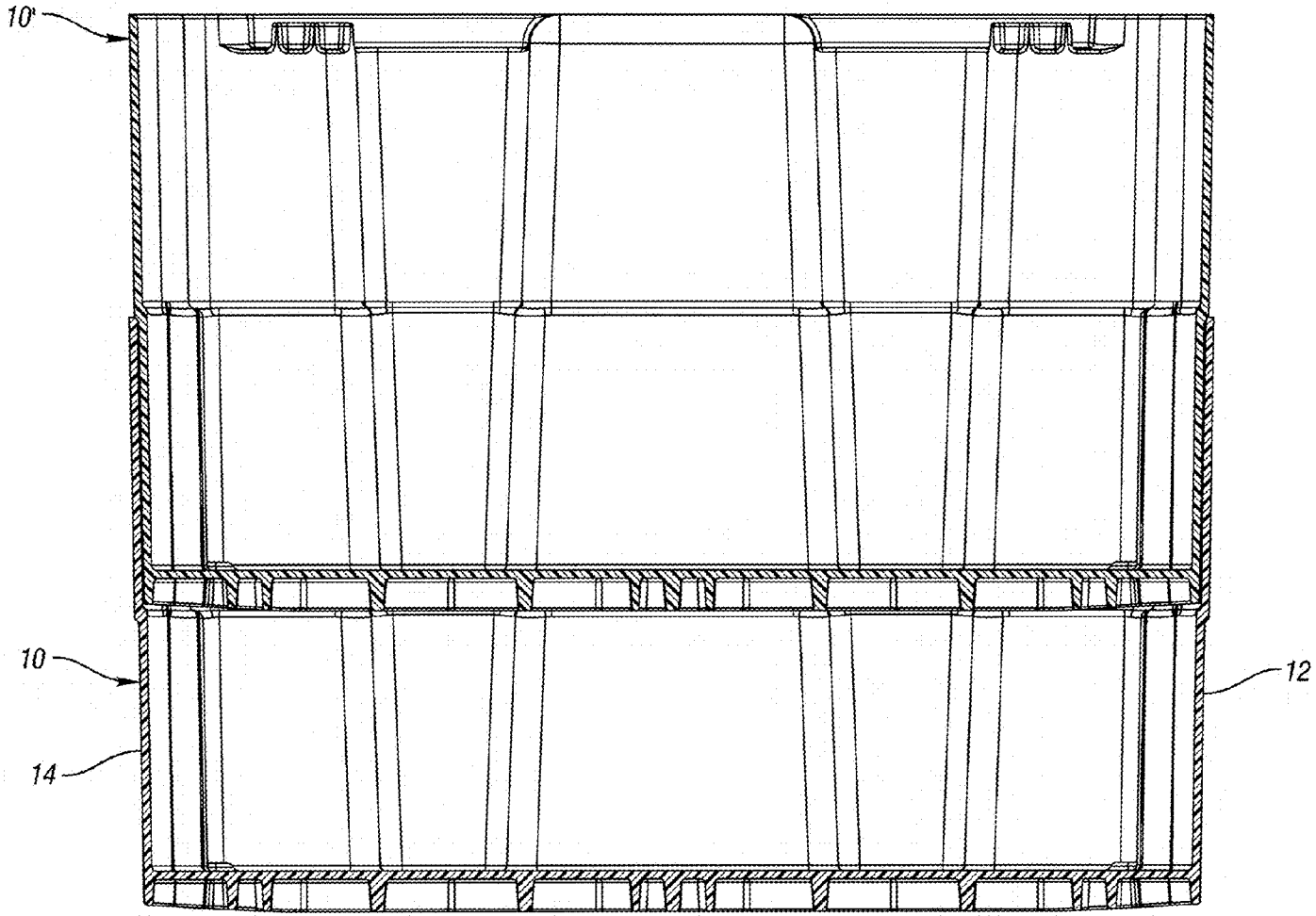
FIG. 8 is a section view taken along line 8-8 of FIG. 7.
Figure 9:
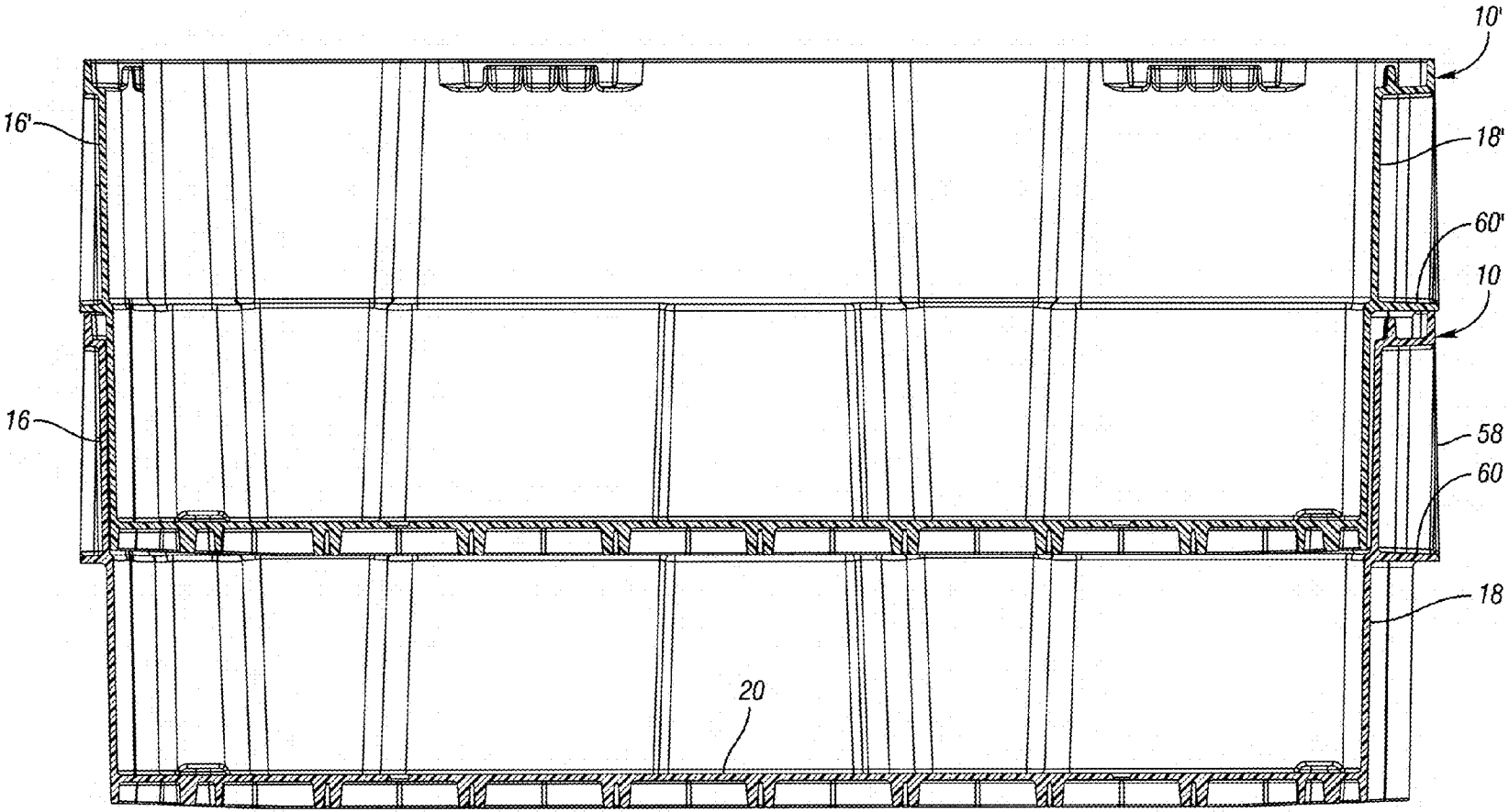
FIG. 9 is a section view taken along line 9-9 of FIG. 7.

FIG. 7 is a perspective view of the container 10 of FIG. 1 with a similar container 10' nested therein. With the containers 10, 10' oriented similarly, the upper container 10' will substantially nest within the lower container 10. As shown in FIGS. 8 and 9, the lower portion of the side walls 12', 14' and end walls 16', 18' fits within the upper portion of the side walls 12, 14 and end walls 16, 18, which substantially reduces the overall height and volume of the containers 10, 10' so that they can be stored more economically when empty. The horizontal ribs 60' on the end wall 18' will rest on the end wall 18. The horizontal rib 49' on the side walls 12', 14' will be supported on the side walls 12, 14.

Figure 10:
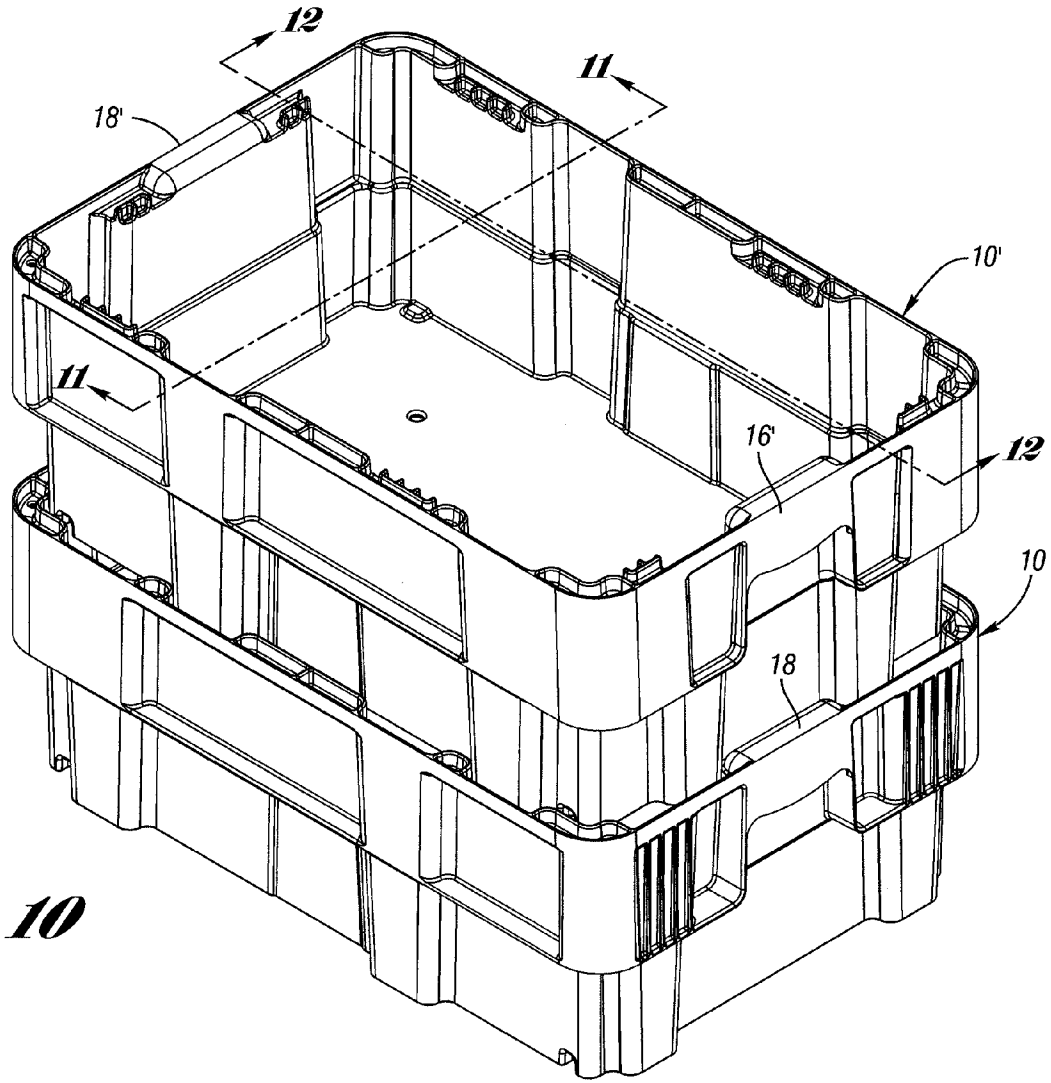
FIG. 10 is a perspective view of the containers of FIG. 7 in a stacked orientation.
Figure 11:
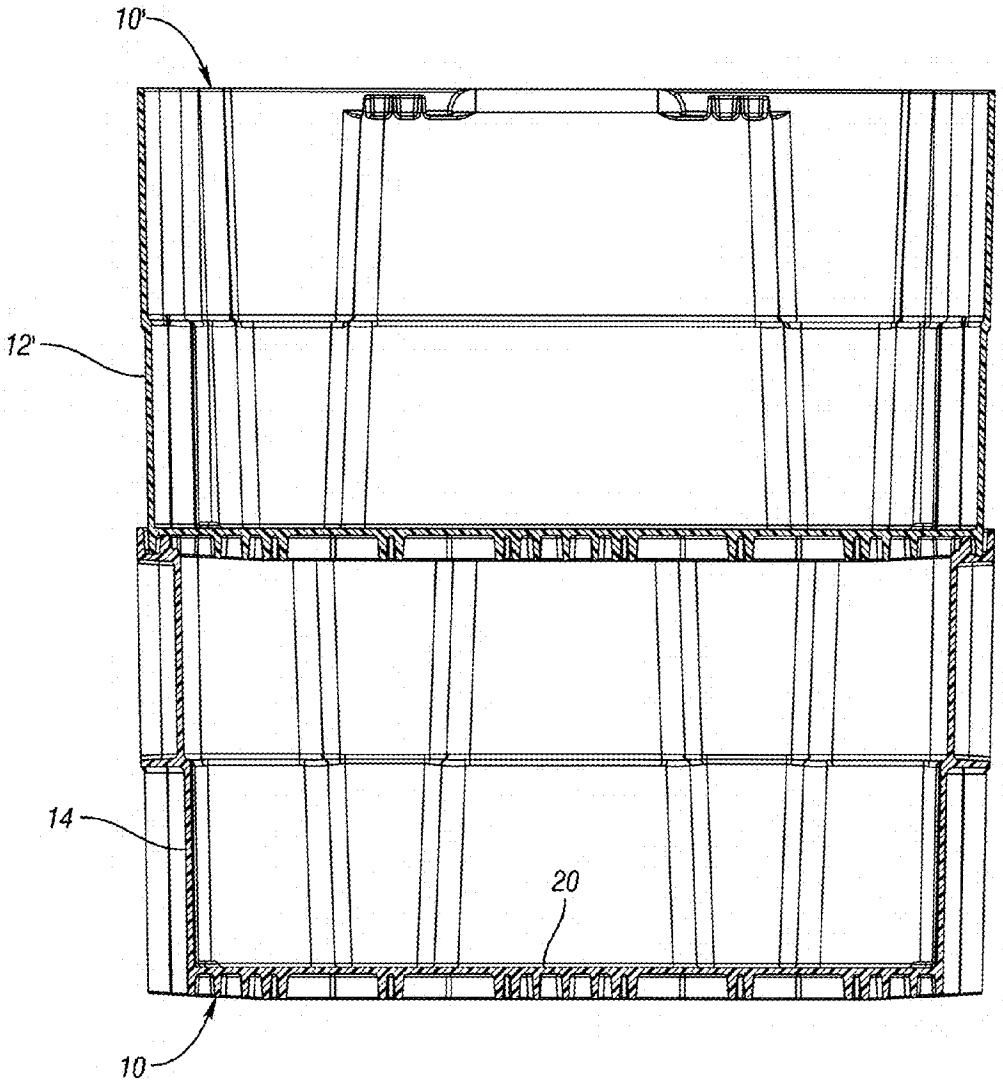
FIG. 11 is a section view taken along line 11-11 of FIG. 10.
Figure 12:
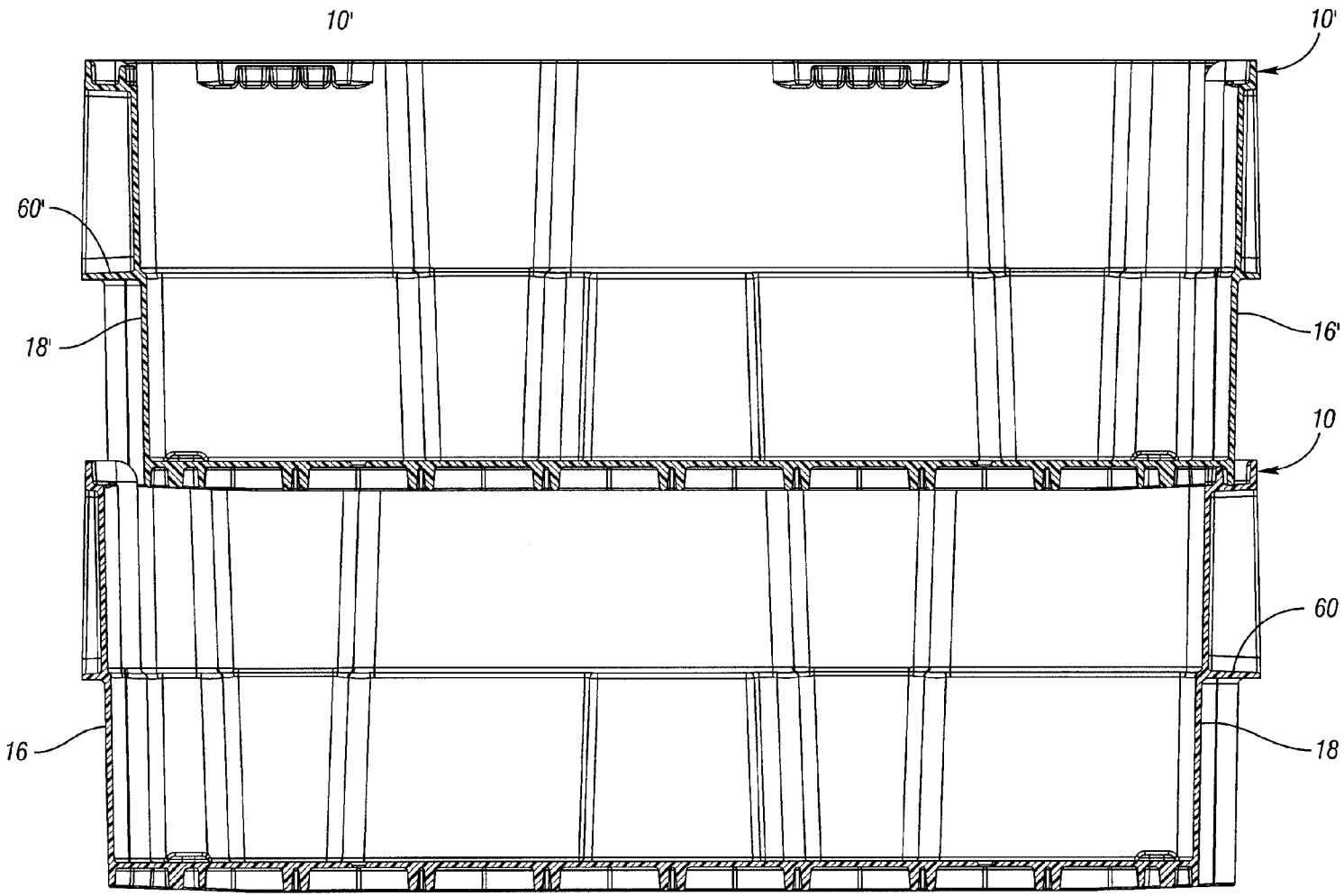
FIG. 12 is a section view taken along line 12-12 of FIG. 10.

FIG. 10 is a perspective view of the containers 10, 10' of FIG. 7 oriented 180 degrees relative to one another and in a stacked orientation. Referring to FIGS. 11 and 12, in the 180 degree orientation, the outer wall portions of the upper container 10' are supported on the inner wall portions of the lower container 10.

Figure 13A:
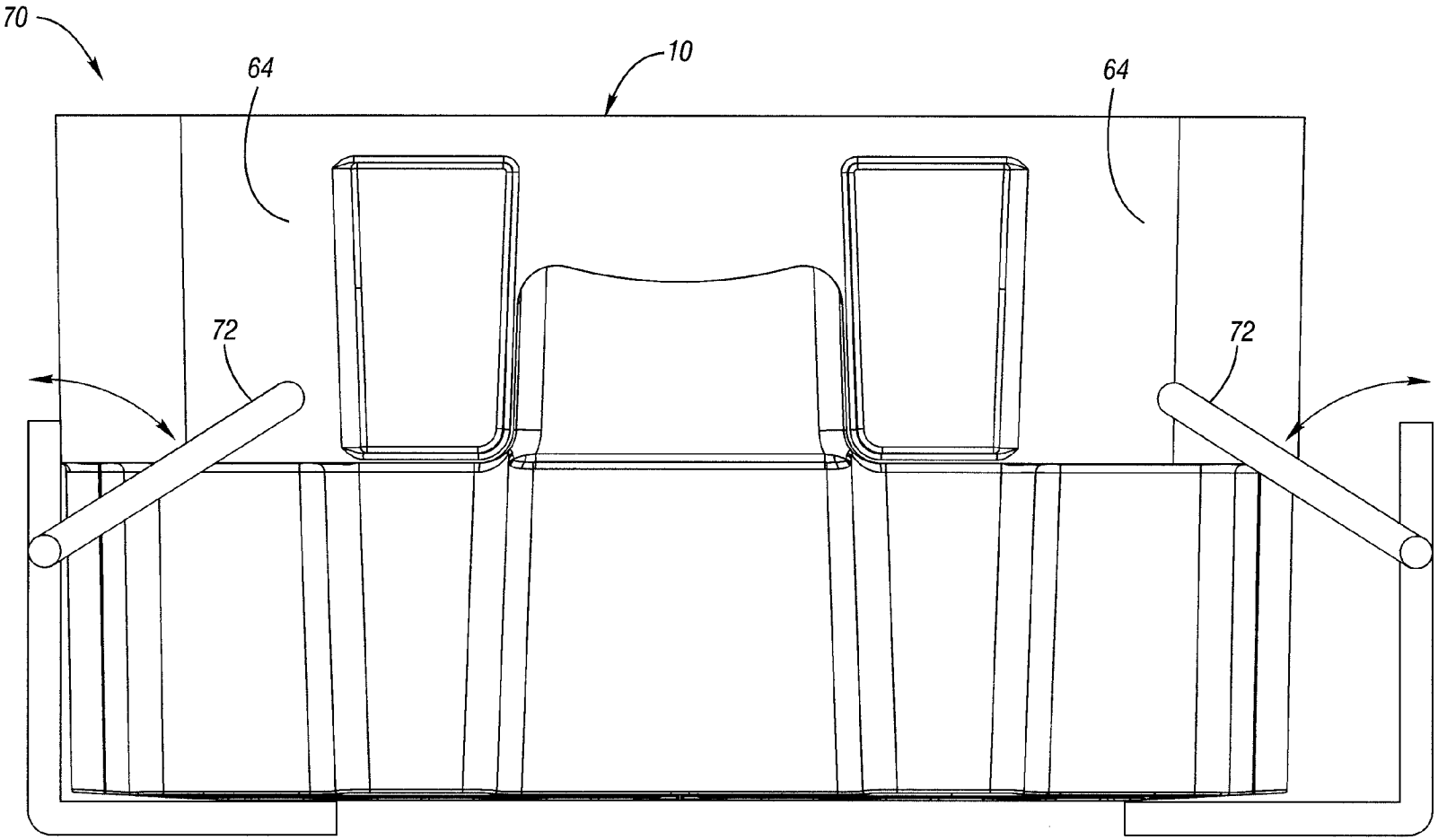
FIG. 13*a* is an end view of the container of FIG. 1 in an automated storage and retrieval system.
Figure 13B:
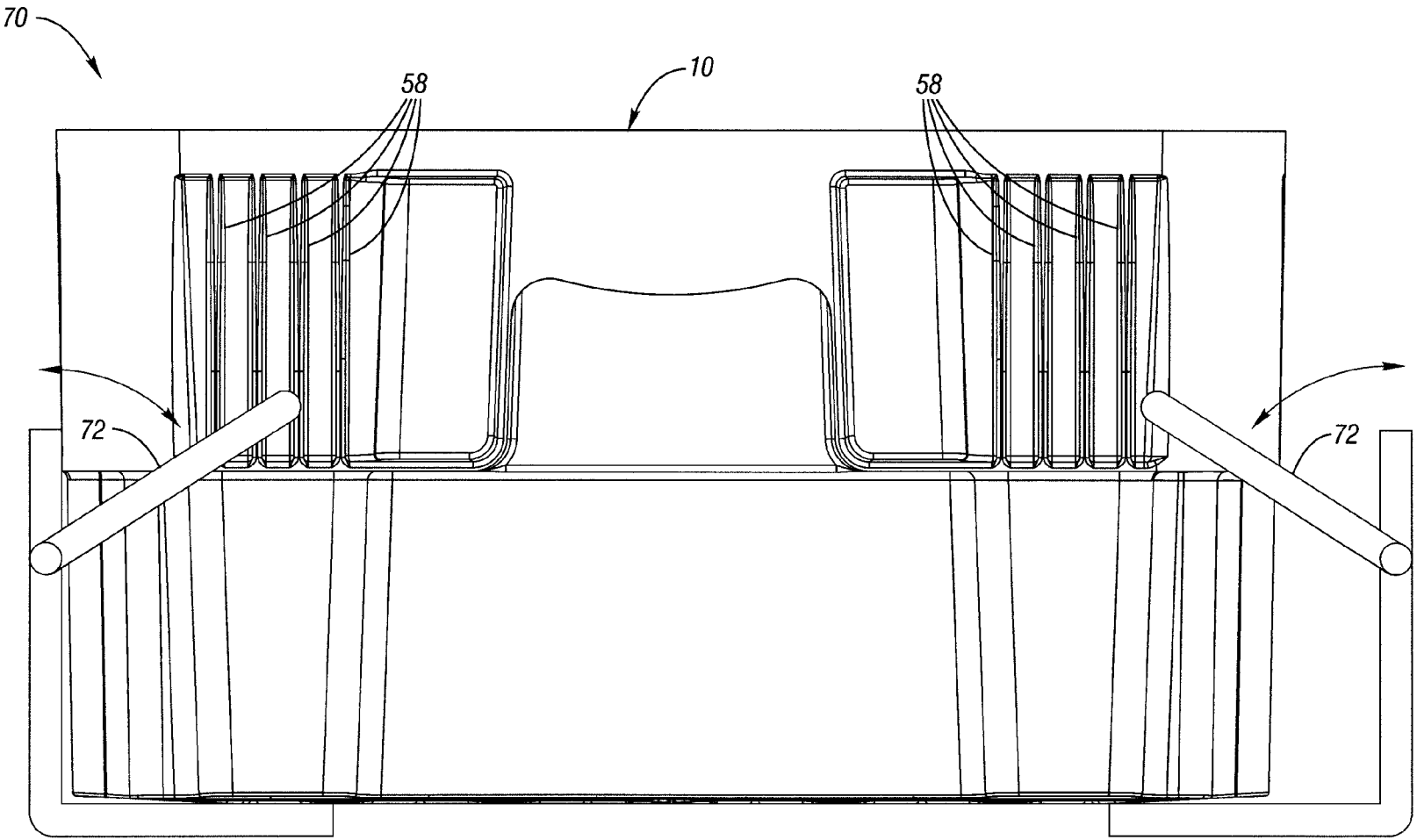
FIG. 13*b* is the other end view of the container in an automated storage and retrieval system.

FIG. 13*a* is an end view of the container 10 in an automated storage and retrieval system 70. The automated storage and retrieval system 70 includes a pair of arms 72 that contact the container 10 to push it along a conveyor or other path. The arms 72 will repeatably contact the container 10 in the same spots. On the one end wall 16, the arms 72 will contact the end face walls 64 (having ribs 66 behind them, as shown in FIG. 3). On the other end wall 18, shown in FIG. 13*b*, the arms will contact the ribs 58. Thus, despite the asymmetric end walls, the container 10 provides consistent, rigid surfaces for contact with the arms 72.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A container comprising:

a floor; and a first wall and an opposed second wall, the first and second wall each including alternating inner portions and outer portions, one of the inner portions of the first wall facing one of the outer portions of the second wall, the one of the inner portions of the first wall and the one of the outer portions of the second wall each including a plurality of reinforcement ribs extending outwardly therefrom, wherein the one of the inner portions of the first wall includes an end wall face at outer ends of the reinforcement ribs formed thereon.

2. The container of claim 1 wherein the second wall includes two outer portions including the one outer portion, reinforcement ribs extending outwardly from the two outer portions of the second wall.

3. The container of claim 1 wherein the reinforcement ribs on the one of the outer portions of the second wall include a plurality of vertically oriented parallel ribs.

4. The container of claim 3 wherein the reinforcement ribs further include a horizontal rib terminating the vertically oriented parallel ribs.

5. The container of claim 1 wherein a similar container can be nested therein when oriented similarly and can be stacked thereon when oriented 180 degrees relative thereto.

6. The container of claim 1 wherein the container is configured to nest with an identical container when oriented similarly and stack when oriented 180 degrees relative to one another.

7. The container of claim 1 wherein the reinforcement ribs on the one of the inner portions of the first wall includes a plurality of vertically oriented parallel ribs.

8. The container of claim 1 wherein the reinforcement ribs on the one of the outer portions of the second wall and the one of the inner portions of the first wall each include a plurality of vertically oriented parallel ribs.

9. The container of claim 1 wherein the end wall face entirely covers the reinforcement ribs.

10. The container of claim 1 wherein the first wall and the opposed second wall are continuous without any openings extending between an outer surface and an inner surface.

11. The container of claim 1 wherein the alternating inner portions and the outer portions are substantially vertical.

12. A container comprising:

a floor; and a first wall and an opposed second wall, the first and second wall each including a plurality of inner portions and a plurality of outer portions, two of the outer portions of the second wall including a plurality of outer reinforcement ribs extending outwardly therefrom, the outer reinforcement ribs having freestanding outer edges defining outer contact surfaces of the container, two of the inner portions of the first wall each include an end wall face at outer ends of inner reinforcement ribs extending outwardly therefrom.

13. The container of claim 12 wherein the reinforcement ribs on the one of the outer portions of the second wall including a plurality of vertically oriented parallel ribs.

14. The container of claim 13 wherein the reinforcement ribs further include a horizontal rib terminating the vertically oriented parallel ribs.

15. The container of claim 12 wherein a similar container can be nested therein when oriented similarly and can be stacked thereon when oriented 180 degrees relative thereto.

16. The container of claim 12 wherein the container is configured such that it would nest with an identical container when oriented similarly and stack when oriented 180 degrees relative to one another.

17. The container of claim 16 wherein a similar container can be nested therein when oriented similarly and can be stacked thereon when oriented 180 degrees relative thereto.

18. The container of claim 12 wherein the reinforcement ribs on the one of the inner portions of the first wall includes a plurality of vertically oriented parallel ribs.

19. The container of claim 12 wherein the reinforcement ribs on the one of the outer portions of the second wall and the one of the inner portions of the first wall each include a plurality of vertically oriented parallel ribs.

20. The container of claim 12 wherein the end wall face entirely covers the reinforcement ribs.

21. The container of claim 12 wherein the first wall and the opposed second wall are continuous without any openings extending between an outer surface and an inner surface.

22. The container of claim 12 wherein the alternating inner portions and the outer portions are substantially vertical.

23. A container comprising:

a floor; and a first wall and an opposed second wall, the first and second wall each including alternating inner portions and outer portions, one of the inner portions of the first wall facing one of the outer portions of the second wall, the one of the inner portions of the first wall and the one of the outer portions of the second wall each including a plurality of reinforcement ribs extending outwardly therefrom, the one of the inner portions including an end wall face at outer ends of the reinforcement ribs formed thereon, wherein the container is configured to nest with an identical container when oriented similarly and stack when oriented 180 degrees relative to one another.

24. The container of claim 23 wherein the reinforcement ribs on the one of the outer portions of the second wall include a plurality of vertically oriented parallel ribs.

25. The container of claim 24 wherein the reinforcement ribs on the one of the outer portions of the second wall further include a horizontal rib terminating the vertically oriented parallel ribs.

26. The container of claim 23 wherein the reinforcement ribs on the one of the inner portions of the first wall includes a plurality of vertically oriented parallel ribs.

27. The container of claim 23 wherein the reinforcement ribs on the one of the outer portions of the second wall and the one of the inner portions of the first wall each include a plurality of vertically oriented parallel ribs.

28. The container of claim 23 wherein the end wall face entirely covers the reinforcement ribs.

29. The container of claim 23 wherein the first wall and the opposed second wall are continuous without any openings extending between an outer surface and an inner surface.

30. The container of claim 23 wherein the alternating inner portions and the outer portions are substantially vertical.

* * * * *

UNITED STATES PATENT AND TRADEMARK OFFICE

CERTIFICATE OF CORRECTION

PATENT NO. : 7,922,001 B2
APPLICATION NO. : 11/548236
DATED : April 12, 2011
INVENTOR(S) : Meers It is certified that error appears in the above-identified patent and that said Letters Patent is hereby corrected as shown below:

In claim 22, column 4, line 29, please replace “alternating” with --plurality of--.

In claim 22, column 4, line 30, please insert --plurality of-- before “outer”.

Signed and Sealed this
Sixth Day of March, 2012

David J. Kappos

David J. Kappos
*Director of the United States Patent and Trademark Office*